US011414292B2

(12) United States Patent
Matsumoto

(10) Patent No.: US 11,414,292 B2
(45) Date of Patent: Aug. 16, 2022

(54) SHEET STACKER, POST-PROCESSING APPARATUS, AND IMAGE FORMING SYSTEM

(71) Applicant: Ricoh Company, Ltd., Tokyo (JP)

(72) Inventor: Takamasa Matsumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/212,057

(22) Filed: Mar. 25, 2021

(65) Prior Publication Data

US 2021/0309482 A1 Oct. 7, 2021

(30) Foreign Application Priority Data

Apr. 1, 2020 (JP) ..... JP2020-065850

(51) Int. Cl.
*B65H 31/38* (2006.01)
*B65H 9/10* (2006.01)
*B65H 7/10* (2006.01)

(52) U.S. Cl.
CPC ..... *B65H 31/38* (2013.01); *B65H 7/10* (2013.01); *B65H 9/101* (2013.01); *B65H 2301/363* (2013.01); *B65H 2301/421* (2013.01); *B65H 2301/4223* (2013.01); *B65H 2701/1315* (2013.01); *B65H 2801/06* (2013.01); *B65H 2801/27* (2013.01)

(58) Field of Classification Search
None
See application file for complete search history.

(56) References Cited

U.S. PATENT DOCUMENTS 7,823,868 B2 * 11/2010 Taki ..... B65H 31/36 270/58.09
7,883,081 B2 * 2/2011 Iguchi ..... B65H 31/02 270/58.17
2012/0294695 A1 11/2012 Sasaki et al.
2013/0001848 A1 1/2013 Hidaka et al.
2013/0001849 A1 1/2013 Suzuki et al.
2013/0228965 A1 9/2013 Hoshino et al.
(Continued)

FOREIGN PATENT DOCUMENTS

JP 9-118468 5/1997
JP 2001089009 A * 4/2001
JP 2009-263127 11/2009

*Primary Examiner* — Leslie A Nicholson, III
(74) *Attorney, Agent, or Firm* — Xsensus LLP

(57) ABSTRACT

A sheet stacker includes a pair of sheet holders, a sheet leading-edge aligner, a sheet stacking member, and control circuitry. A downstream side of the pair of sheet holders in a conveyance direction of a conveyed sheet is lowered along the conveyance direction. Each one of the pair of sheet holders is movable in an orthogonal direction to the conveyance direction. The pair of sheet holders hold both side-end portions of the sheet in the orthogonal direction. The sheet stacking member is disposed below the pair of sheet holders. A downstream side of the sheet stacking member in the conveyance direction is lowered along the conveyance direction. The sheet stacking member stacks the sheet dropped from the pair of sheet holders after a leading edge of the sheet is aligned by the leading-edge aligner. The control circuitry controls operations of the leading-edge aligner and the pair of sheet holders.

12 Claims, 10 Drawing Sheets

(56) References Cited

U.S. PATENT DOCUMENTS

| | | | |
|---|---|---|---|
| 2013/0270763 | A1 | 10/2013 | Furuhashi et al. |
| 2014/0062003 | A1 | 3/2014 | Niitsuma et al. |
| 2014/0062005 | A1 | 3/2014 | Suzuki et al. |
| 2014/0062016 | A1 | 3/2014 | Watanabe et al. |
| 2014/0145395 | A1 | 5/2014 | Takano et al. |
| 2014/0159301 | A1 | 6/2014 | Suzuki et al. |
| 2014/0203501 | A1 | 7/2014 | Hoshino et al. |

* cited by examiner

SHEET STACKER, POST-PROCESSING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2020-065850, filed on Apr. 1, 2020, in the Japan Patent Office, the entire disclosure of which is hereby incorporated by reference herein.

BACKGROUND

Technical Field

Embodiments of the present disclosure relate to a sheet stacker, a post-processing apparatus, and an image forming system.

Related Art

There is known an image forming system that includes an image forming apparatus to discharge liquid onto a sheet-shaped medium and a sheet stacker to stack the medium on which the image is formed. Such an image forming system may include a post-processing apparatus that aligns a medium on which an image is formed in a sheet stacker and performs post-processing such as binding processing on an end portion of the medium.

As the sheet stacker, for example, a sheet stacker is known that causes a leading edge of a sheet (medium) to butt against a stopper to be aligned.

SUMMARY

According to an aspect of the present disclosure, there is provided a sheet stacker that includes a pair of sheet holders, a sheet leading-edge aligner, a sheet stacking member, and control circuitry. The pair of sheet holders are disposed so that a downstream side of the pair of sheet holders in a conveyance direction of a conveyed sheet is lowered along the conveyance direction. Each one of the pair of sheet holders is movable in an orthogonal direction orthogonal to the conveyance direction of the sheet. The pair of sheet holders hold both side-end portions of the sheet in the orthogonal direction. The sheet leading-edge aligner prevents the sheet from passing through a conveyance passage of the sheet. The sheet leading-edge aligner is movable between an alignment position to align a leading edge of the sheet in the conveyance direction and a retreat position to allow the sheet to pass. The sheet leading-edge aligner aligns the leading edge of the sheet held by the pair of sheet holders when the sheet leading-edge aligner is at the alignment position. The sheet stacking member is disposed below the pair of sheet holders so that a downstream side of the sheet stacking member in the conveyance direction of the sheet is lowered along the conveyance direction. The sheet stacking member stacks the sheet dropped from the pair of sheet holders after the leading edge of the sheet is aligned by the sheet leading-edge aligner. The control circuitry controls operations of the sheet leading-edge aligner and the pair of sheet holders.

According to another aspect of the present disclosure, there is provided a post-processing apparatus that includes the sheet stacker, a post-processing device, and a conveyor.

The post-processing device performs post-processing on a sheet bundle including a plurality of sheets stacked on the sheet stacking member. The conveyor conveys the sheet bundle on which the post-processing has been performed to a downstream side from the post-processing device in the conveyance direction. The control circuitry causes the sheet leading-edge aligner and the post-processing device to retreat from the conveyance passage after the post-processing has been performed on the sheet bundle.

According to still another aspect of the present disclosure, there is provided an image forming system that an image forming device, a conveying device, and the post-processing apparatus. The image forming device discharges liquid onto a sheet to form an image. The conveying device conveys the sheet. The post-processing apparatus performs the post-processing on a sheet bundle including the sheet on which the image is formed by the image forming device and conveyed by the conveying device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
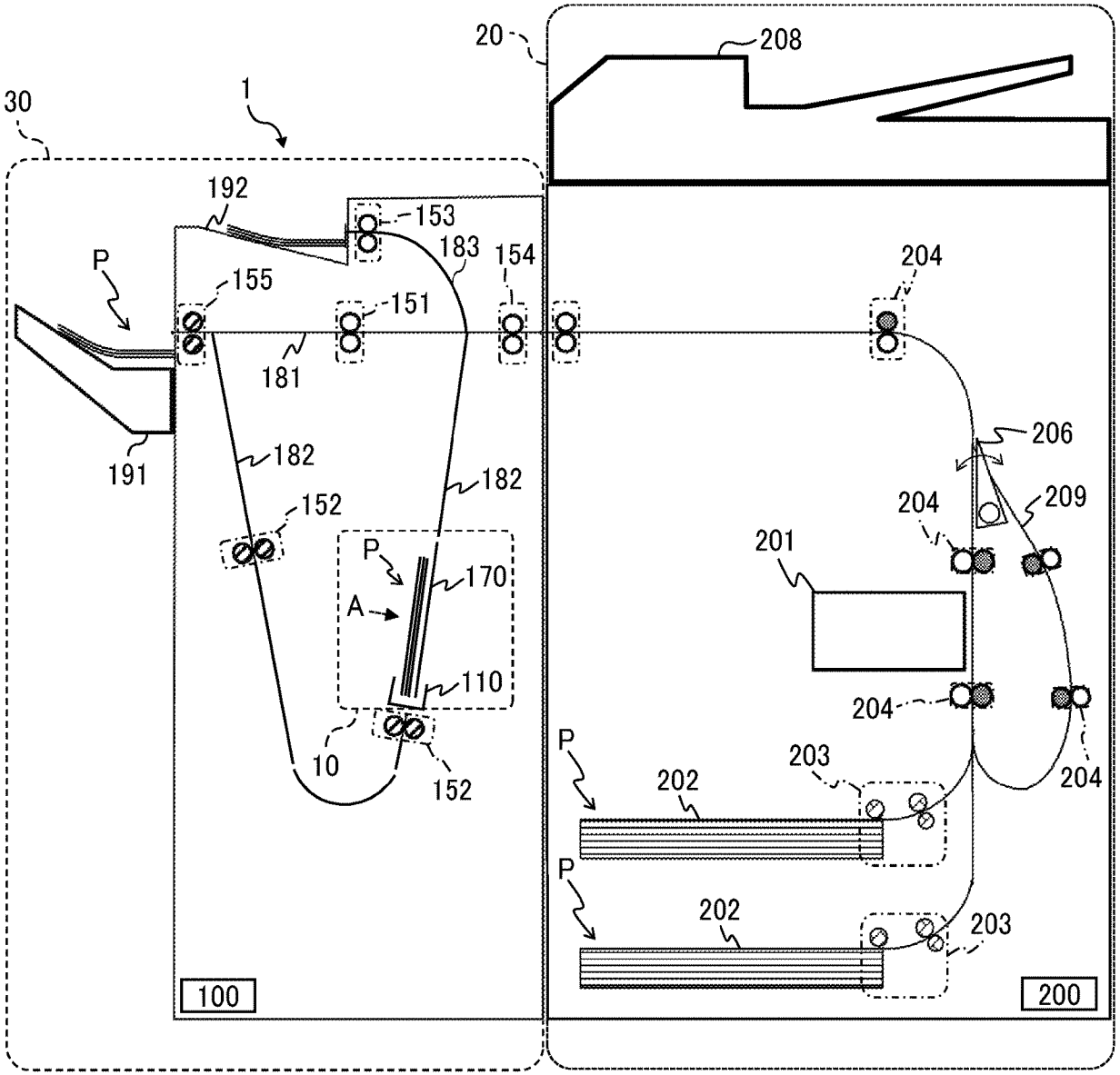
FIG. 1 is a schematic diagram of a printing system as an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Hereinafter, a sheet stacker, a post-processing apparatus, and an image forming system according to embodiments of the present disclosure are described with reference to drawings. As the sheet stacker according to an embodiment of the present disclosure, a sheet stacking unit 10 is exemplified that performs "alignment processing" of aligning an end portion of a sheet-shaped medium ejected from an image forming apparatus to stack sheet-shaped media. In addition, as the post-processing apparatus according to an embodiment of the present disclosure, a post-processing unit 30 is exemplified that performs binding processing on an end portion of a sheet bundle aligned in the sheet stacking unit 10. The sheet stacking unit 10 is disposed so as to be included in the post-processing unit 30. In a printing system 1 as an image forming system, an inkjet printer 20 as an image forming apparatus is exemplified. The printing system 1 includes a post-processing unit 30 that performs predetermined post-processing (binding processing) on a sheet P on which an image has been formed in the inkjet printer 20.

Embodiment of Image Forming Apparatus

FIG. 1 is a diagram illustrating an overall configuration of a printing system 1 that is an image forming system according to an embodiment of the present disclosure. The printing system 1 includes an inkjet printer 20 as an image forming apparatus, and a sheet stacking unit 10 as a sheet stacker that conveys and stacks sheets P, which are sheet-shaped media conveyed from the inkjet printer 20, using a predetermined conveyance passage. The sheet stacking unit 10 is disposed inside a post-processing unit 30 as a post-processing apparatus. The sheet P refers to any medium, such as paper (paper), an OHP sheet, yarn, fiber, fabric, leather, metal, or plastic, on which an image is formed by attaching ink and which can be conveyed while being curved.

Overview of Inkjet Printer 20

First, an overview of the inkjet printer 20 is described. The inkjet printer 20 includes an image forming device 201, a sheet container 202 including sheet feeding trays, a sheet feeding device 203 as a sheet feeder, a sheet conveying device 204 as a sheet conveyor, a sheet reverse passage changer 206 as a conveyance passage switching device, a document reading device 208 as a document reader, a sheet reverse passage 209 through which a sheet is conveyed for forming images on both sides of the sheet, and a controller 200 as a control device or circuitry.

The controller 200 controls the overall operations of the configuration included in the inkjet printer 20. The controller 200 has a communication function of transmitting and receiving information to and from a controller 100 included in the sheet stacking unit 10, and controls operations of the image forming device 201 and the sheet conveying device 204 in conjunction with the operation of the sheet stacking unit 10. The controller 200 notifies the controller 100 as a control device or circuitry included in the sheet stacking unit 10 described later of sheet-related information related to a sheet P that is a target of the image forming process. Details of the sheet-related information and the like are described later.

The image forming device 201 as an image forming device includes liquid discharge heads having ejection ports (nozzles) to discharge liquid inks of four colors of, for example, Y (yellow), M (magenta), C (cyan), and K (black). The liquid discharge head is separately provided to discharge liquid ink of each color. The liquid ink is supplied to each liquid discharge head included in the image forming device 201 by an ink supply pump that is coupled with each ink cartridge. Therefore, the liquid ink is supplied to each liquid discharge head by the ink supply pump from the ink cartridge containing the liquid ink of each color. Note that the ink cartridge of each color is detachably attached to a cartridge charger included in the inkjet printer 20.

The sheet container 202 includes a plurality of sheet feed trays each loading and containing a sheet P that functions as a sheet medium.

The sheet feeding device 203 includes a sheet pickup roller, a sheet separation roller, and a sheet reverse roller. The pickup roller picks up some of the sheets P contained in the sheet container 202. The separation roller and the sheet reverse roller separate and feed the picked-up sheets P one by one.

The sheet conveying device 204 includes the plurality of pairs of sheet conveying rollers disposed at different positions along the sheet conveyance passage of the sheet P. Each pair of sheet conveying rollers includes a sheet conveying roller and a spur wheel. Each pair of sheet conveying rollers is rotated by a conveyance drive device to convey the sheet P in the predetermined direction at the predetermined conveying speed. Note that one of the pair of sheet conveying rollers is not limited to a spur wheel but may be a rotary body that has the substantially same size of the contact area to contact the sheet P as the contact area of the spur wheel and that partially contacts the sheet P. For example, the rotary body may be an abrasive roller having an abrasive surface.

The sheet reverse passage changer 206 includes a switching claw that guides the sheet P to the sheet reverse passage 209. The sheet reverse passage 209 reverses the image forming surface of the sheet P and conveys the sheet P to the image forming device 201. When images are formed on both sides (i.e., the front and back faces) of the sheet P, the sheet P having an image formed by the image forming device 201 on the first side (e.g., the front face) is temporarily conveyed downstream in a conveyance direction until the trailing edge of the sheet P passes the sheet reverse passage changer 206. Then, after the sheet reverse passage changer 206 changes the sheet conveyance passage, the sheet P is conveyed in reverse, in other words, upstream in the conveyance direction, so that the sheet P is conveyed to another sheet conveyance passage that guides the sheet P form the sheet reverse passage 209 to the image forming device 201. Thereafter, the image forming device 201 forms an image on the second face of the reversed sheet P that faces the image forming device 201. The second face of the sheet P is the opposite face of the first face (e.g., the back face).

Overview of Post-Processing Unit 30

As illustrated in FIG. 1, the post-processing unit 30 is connected to a subsequent stage of the inkjet printer 20, and includes a mechanism that performs predetermined post-processing on a sheet P on which an image has been formed in the inkjet printer 20. The post-processing unit 30 includes the sheet stacking unit 10 as an alignment processing mechanism.

The post-processing unit 30 conveys the sheet P ejected from an ejection port of the inkjet printer 20 by a pair of carry-in rollers 154 as conveyors to any one of a first conveyance passage 181, a second conveyance passage 182, and a third conveyance passage 183 according to usage. The first conveyance passage 181 is provided with a pair of first conveying rollers 151 as conveyors and formed in a substantially straight shape to convey the sheet P to a shift ejection tray 191. The second conveyance passage 182 is provided with a pair of second conveying rollers 152 as conveyors, is branched from the first conveyance passage 181, and is formed to have a substantially V-shape to convey the sheet P to the shift ejection tray 191. The substantially V-shape of the second conveyance passage 182 is formed of one conveyance passage part inclined to be lower on the downstream side in the conveyance direction, another conveyance passage part inclined to be higher on the downstream side in the conveyance direction, and a curved conveyance passage connecting the two conveyance passage parts. The third conveyance passage 183 is provided with a pair of third conveying rollers 153 as conveyors and branched from the first conveyance passage 181 to convey the sheet P to an ejection tray 192.

The first conveyance passage 181 is a conveyance passage for ejecting the sheet P to the shift ejection tray 191 as an ejection tray of the sheet P. The shift ejection tray 191 also corresponds to a sorting unit that performs "sort processing" of changing the stacking position of ejected sheets P in a predetermined unit.

The third conveyance passage 183 is a passage for ejecting a sheet P to the ejection tray 192 provided in an upper portion of a housing of the post-processing unit 30. Sheets are stacked on the ejection tray 192 in the ejection order.

The second conveyance passage 182 is a conveyance passage that conveys a sheet P to the sheet stacking unit 10 as a sheet stacker that aligns the end portion of the sheet P in order to perform stapling processing (binding processing) as post-processing in the post-processing unit 30.

Overview of Sheet Stack Unit 10

As illustrated in FIG. 1, the sheet stacking unit 10 is disposed inside the post-processing unit 30 connected to the subsequent stage of the inkjet printer 20 and includes a leading-edge stopper 110 to align the leading edge of the sheet P on which an image has been formed in the inkjet printer 20. The leading-edge stopper 110 is disposed downstream from the stack tray 170 in the conveyance direction of the sheet P. The stack tray 170 constitutes a part of the second conveyance passage 182 (in other words, a portion of the conveyance passage inclined so that the downstream side in the conveyance direction is lower), which is one of the conveyance passages of the sheet P.

Sheet Stacking Unit According to First Embodiment

Figure 2:
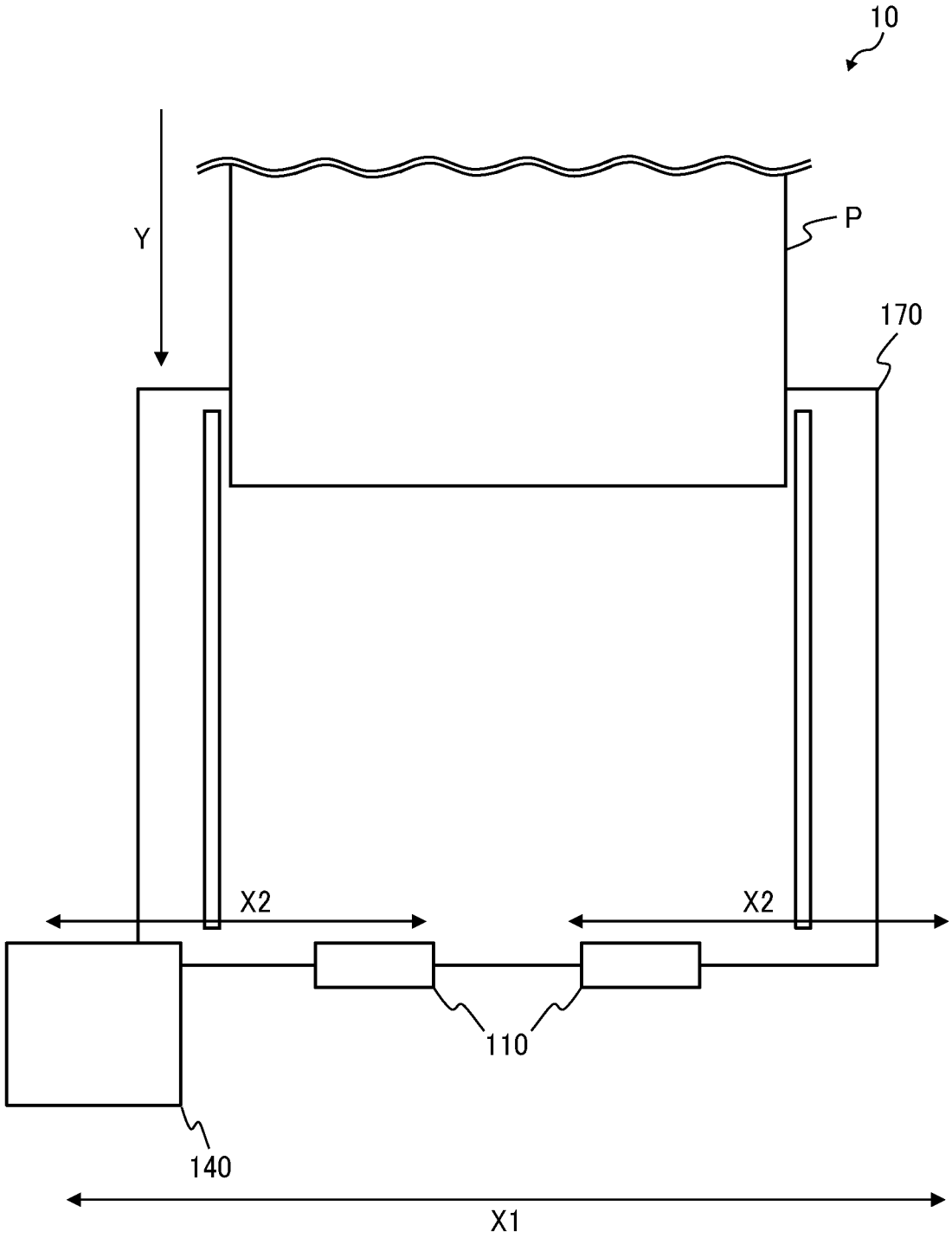
FIG. 2 is a schematic view of a sheet stacking unit as a sheet stacker according to a first embodiment of the present disclosure.
Figure 3:
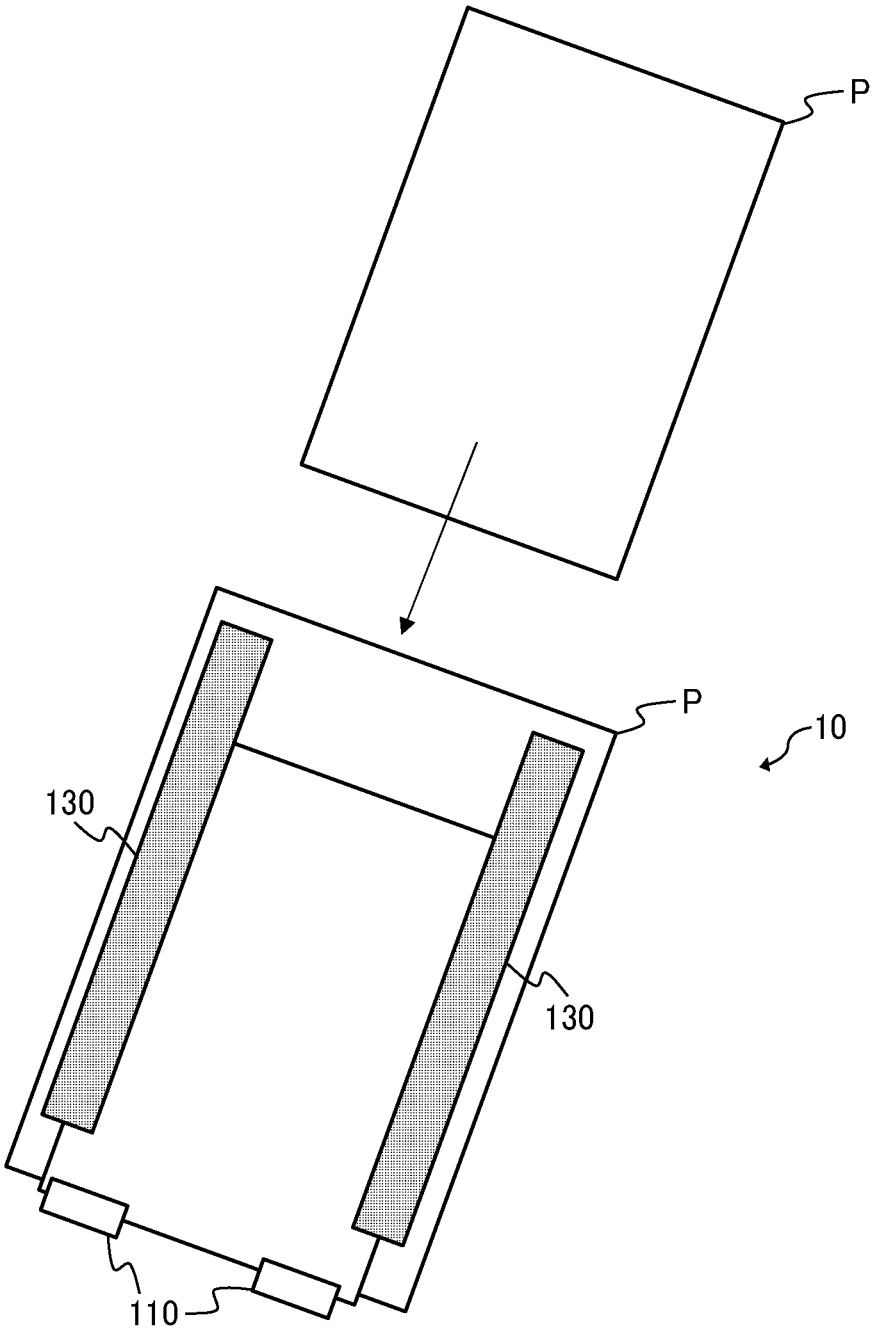
FIG. 3 is a plan view illustrating an outline of the sheet stacking unit as the sheet stacker according to the first embodiment.
Figure 4:
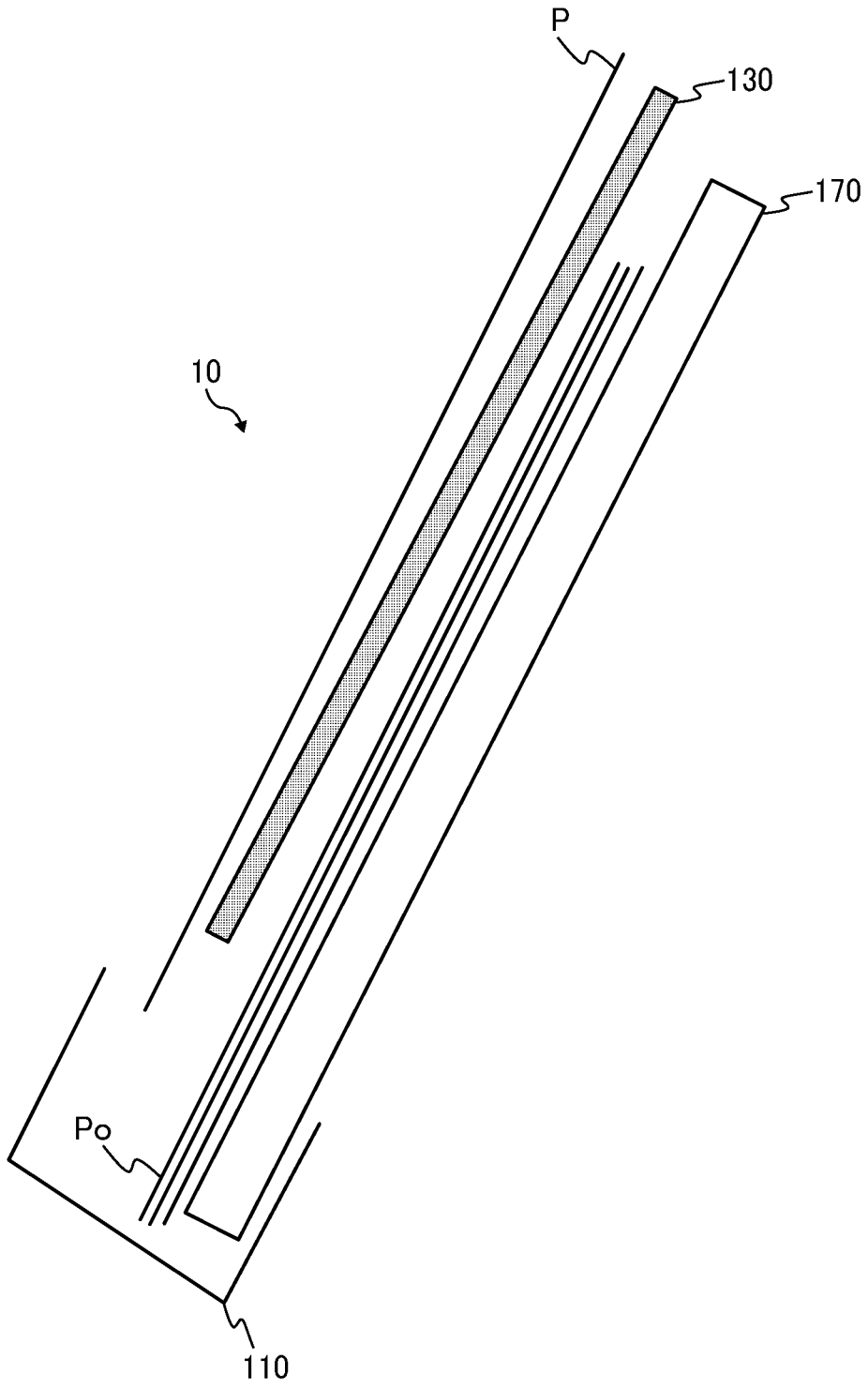
FIG. 4 is a side view illustrating an outline of the sheet stacking unit as the sheet stacker according to the first embodiment.

Next, a main configuration of the sheet stacking unit 10 is described with reference to FIGS. 2, 3, and 4. FIG. 2 is a plan view of the sheet stacking unit 10 as viewed in the direction indicated by arrow A in FIG. 1. FIG. 3 is a plan view of the sheet stacking unit 10 in a state in which the sheet P is conveyed. FIG. 4 is a side view of the sheet stacking unit 10 in a state in which the sheet P is conveyed.

As illustrated in FIG. 2, the sheet stacking unit 10 includes a stack tray 170 serving as a sheet stacking member and a pair of leading-edge stoppers 110 serving as a sheet leading-edge aligner. A stapler 140 as a post-processing device is disposed downstream from the stack tray 170 in a conveyance direction of the sheet P.

The sheet P is conveyed from a direction indicated by arrow Y in FIG. 2 via the second conveyance passage 182 and stacked on the stack tray 170. The pair of leading-edge stoppers 110 is disposed at an end portion of the stack tray 170 and on the downstream side in the conveyance direction of the sheet P. A leading edge portion (leading edge) of the sheet P in the conveyance direction butts against and is supported by the pair of leading-edge stoppers 110. The stapler 140 includes a mechanism capable of moving in an orthogonal direction orthogonal to the conveyance direction of the sheet P and performs binding processing on the sheet P whose leading edge is aligned at the pair of leading-edge stoppers 110.

The pair of leading-edge stoppers 110 are movable in a width direction of the sheet P (in other words, the orthogonal direction orthogonal to the conveyance direction) to separate from each other in outer directions of the stack tray 170 and approach each other in opposite directions to the outer directions of the stack tray 170. As a result, when the sheet P for which alignment and binding processing have been finished is conveyed in the conveyance direction indicated by arrow Y, the pair of leading-edge stoppers 110 can be retreated to positions at which the pair of leading-edge stoppers 110 do not interfere with conveyance of the sheet P (in other words, positions at which the pair of leading-edge stoppers 110 do not block passage of the sheet P). The stapler 140 is also movable in the width direction of the sheet P. When the sheet P on which binding processing has been finished is conveyed in the conveyance direction indicated by arrow Y, the stapler 140 can be retracted to a position at which the stapler 140 does not interfere with conveyance of the sheet P (a position at which the stapler 140 does not block the passage of the sheet P).

First Embodiment

As illustrated in FIGS. 3 and 4, a pair of holding members 130 as a pair of sheet holders is disposed between the conveyed sheet P and the uppermost one of sheets Po stacked on the stack tray 170. Each one of the holding members 130 is movable to the outside of the stack tray 170 in the width direction of the sheet P. When the sheet P held by the pair of holding members 130 are dropped and stacked on the stack tray 170 or when the sheets P are stacked on the stack tray 170 without being held by the pair of holding members 130, the pair of holding members 130 are moved in directions away from each other. The position of the pair of holding members 130 illustrated in FIG. 3 corresponds to a receiving position (initial position) as a predetermined position of the sheet P with respect to the stack tray 170. In other words, the receiving position is a position at which end portions (both side end portions) in the width direction of the conveyed sheet P can be held by the pair of holding members 130. When the pair of holding members 130 is at the initial position, each one of the holding members 130 extending with the conveyance direction of the sheet P as the longitudinal direction is positioned above the stack tray 170, and is in a state of supporting (holding) the side end portions of the conveyed sheet P from below.

The holding member 130 is formed of a thin plate-shaped member having a rectangular shape in a plan view and having a length equal to or shorter than the dimension of the stack tray 170 in the length direction (in other words, the conveyance direction of the sheet P). The surface of the holding member 130 has such a degree of smoothness that the conveyed sheet P comes into contact with and slides on the surface. The contact area of the holding member 130 is desirably as small as possible when the sheet P comes into contact with the holding member. Therefore, the surface is more desirably embossed with minute hemispheres.

The holding members 130 assist (guide) the sheet P so that the leading edge of the sheet P butts against the leading-edge stoppers 110 while the surface of the sheet P butts against the leading-edge stopper 110 without impairing the momentum of the conveyed sheet P. The holding members 130 hold the sheet P whose leading edge has butted against the leading-edge stoppers 110. Further, in order to stack the held sheet P on the stack tray 170 as the uppermost one of the sheets Po, the holding members 130 are moved outward from the side edges in the width direction of the held sheet. The outward movement causes the sheet P to fall toward the stack tray 170 and be stacked on the uppermost position of the sheets Po with the leading edge of the sheet P butting against the leading-edge stoppers 110.

Therefore, in the sheet stacking unit 10 according to the present embodiment, when the sheet P is stacked on the stack tray 170 after being temporarily held by the holding members 130, the holding members 130 support the sheet P in an auxiliary manner until the leading edge of a newly conveyed sheet P butts against the leading-edge stoppers 110, thus forming a state in which the sheet P does not directly contact the already stacked sheets Po. Such a configuration can prevent the sheet P and an image formed on the sheets Po from rubbing against each other when the sheet P is stacked on the stack tray 170.

Second Embodiment

A sheet stacker according to a second embodiment of the present disclosure is described with reference to FIGS. 5A, 5B, 6A, 6B, and 6C. In a sheet stacking unit 10*a* as the sheet stacker according to the present embodiment, each one of a pair of holding members 131 serving as a pair of sheet holders that is an example of a sheet stacking assistance device is divided into a plurality of pieces in the conveyance direction of a sheet P. A slight gap is formed between the divided pieces constituting each one of the pair of holding members 131 (in the conveyance direction of the sheet P). The plurality of divided pieces constituting each one of the pair of holding members 131 are movable together as a single unit.

Figure 5A:
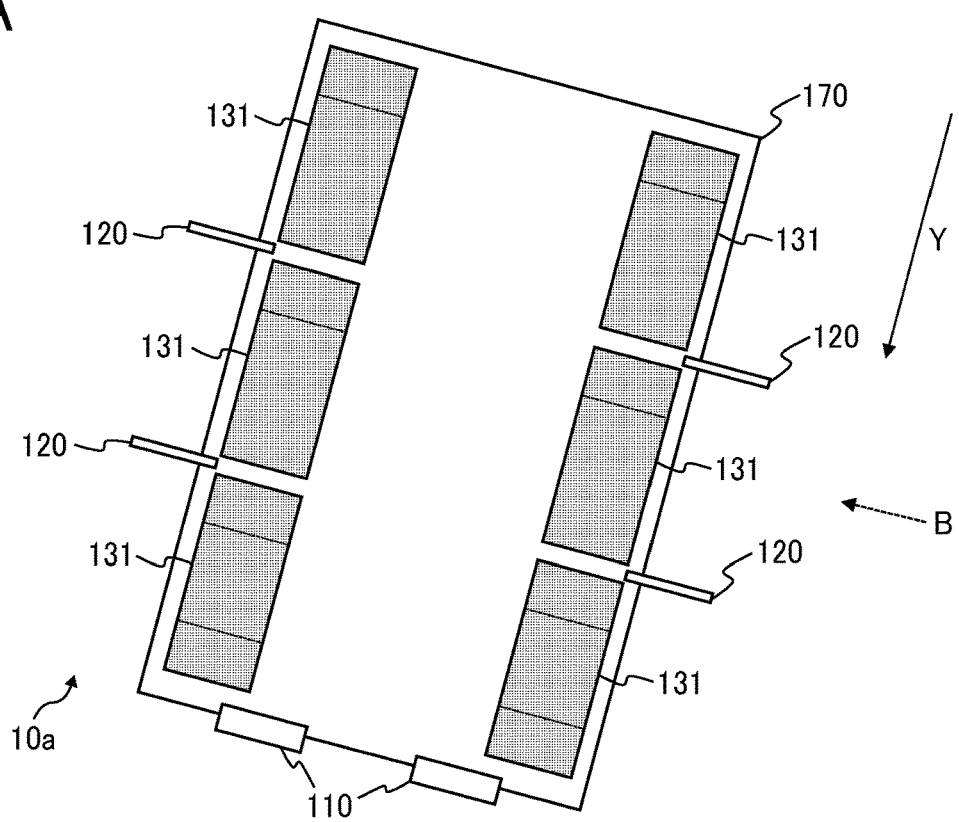
FIGS. 5A and 5B are schematic views illustrating an outline of a sheet stacking unit as a sheet stacker according to a second embodiment of the present disclosure.
Figure 5B:
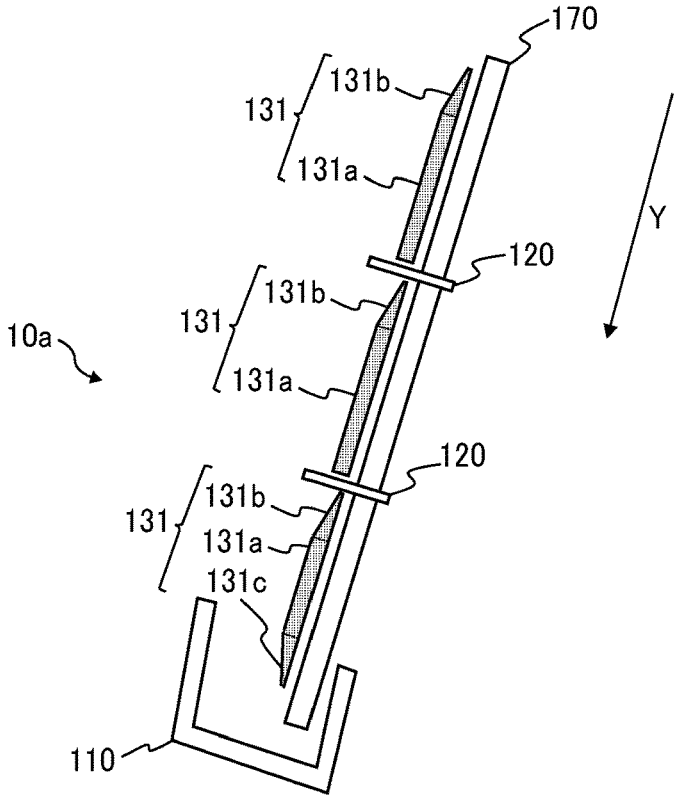

FIG. 5B illustrates a side view of the sheet stacking unit 10A seen from the direction indicated by arrow B in FIG. 5A. As illustrated in FIG. 5B, each one of the divided pieces constituting the pair of holding members 131 has a first inclined surface 131*b* forming an upward inclination from an upstream end portion in the conveyance direction of the sheet P toward the leading-edge stoppers 110 (in other words, toward the downstream side in the conveyance direction). When the sheet P is conveyed, the first inclined surface 131*b* assists a leading edge portion of the sheet P to move (guide) downstream in the conveyance direction without falling into the gaps between the divided pieces in the conveyance direction. Each one of the divided pieces constituting the pair of holding members 131 has a first support surface 131*a* that is a surface substantially parallel to the stacking surface of the stack tray 170 and supports the sheet P. The first support surface 131*a* allows the conveyed sheet P to be guided and moved (conveyed) until the leading edge butts against the leading-edge stoppers 110 without butting against other sheet P (sheets Po) already stacked on the stack tray 170.

Each one of the divided pieces disposed at the positions closest to the leading-edge stoppers 110 has a second inclined surface 131*c* that is inclined downward toward a downstream end portion in the conveyance direction of the sheet P. The leading edge of the conveyed sheet P is guided by the second inclined surfaces 131*c* to reliably butt against the leading-edge stoppers 110.

Further, pairs of joggers 120 as pairs of sheet side-edge aligners are disposed in gaps between the divided pieces in the conveyance direction. As a receiving position (initial position) of the sheet P, each pair of joggers 120 are placed outside end portions (both side end portions) of the conveyed sheet P in the width direction of the conveyed sheet P.

Next, the operations of the pair of holding members 131 and the pairs of joggers 120 until a conveyed sheet P is stacked on the stack tray 170 are described with reference to FIGS. 6A, 6B, and 6C.

Figure 6A:
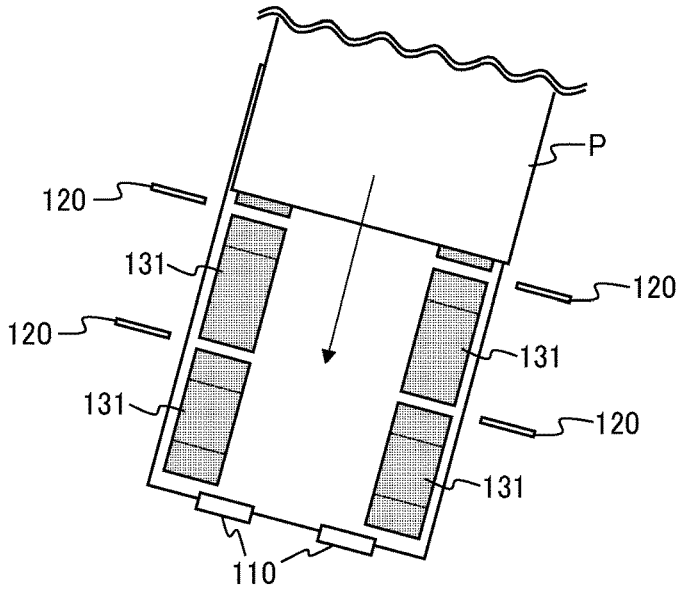
FIGS. 6A, 6B, and 6C are schematic views illustrating an operation example of the sheet stacking unit as the sheet stacker according to the second embodiment.

FIG. 6A illustrates a state in which a sheet P conveyed to the stack tray 170 reaches the vicinity of an upstream end portion of the stack tray 170 in the conveyance direction of the sheet P. At this time, each pair of joggers 120 are in a standby state at receiving positions outside the pair of holding members 131 in the width direction of the sheet P (in other words, an orthogonal direction orthogonal to the conveyance direction) and outside the stack tray 170. On the other hand, the pair of holding members 131 are in a standby state at positions above the end portions (vicinities of both side end portions) of the stack tray 170 in the width direction to support (hold) the end portions (both side end portions) of the sheet P in the width direction. The positions are defined as receiving positions in the pair of holding members 131.

Figure 6B:
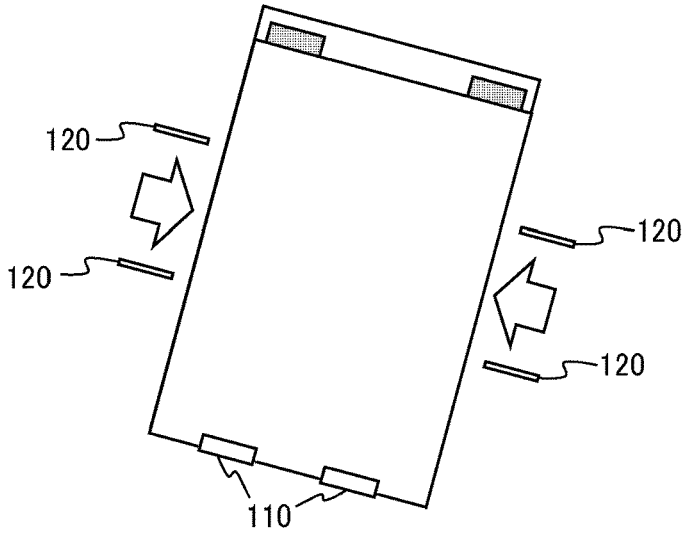

As illustrate in FIG. 6B, when the leading edge of the sheet P butts against the leading-edge stoppers 110, the sheet P is supported (held) by the pair of holding members 131. When the sheet P is maintained in this state and a predetermined period of time has elapsed, side end alignment processing is performed to cause each pair of joggers 120 to approach and come into contact with both side edges of the sheet P and align the positions of the side edges of the sheet P with the positions of each pair of the joggers 120. At this stage, the leading edge and the side edges of the sheet P are aligned at the alignment positions on the pair of holding members 131.

Figure 6C:
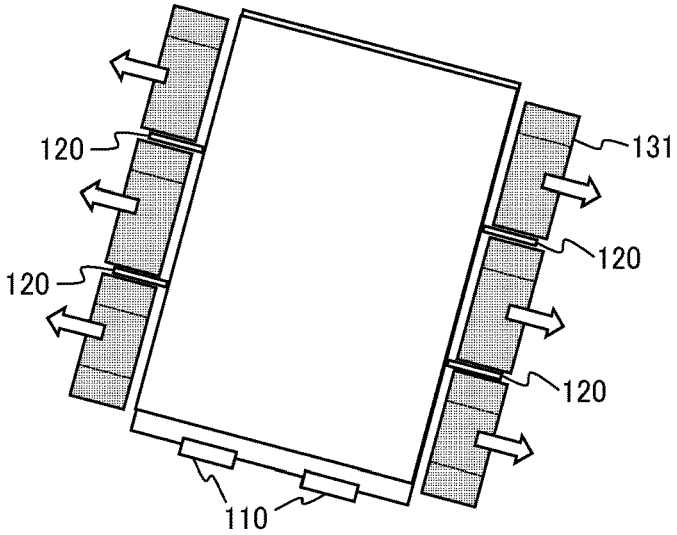

Subsequently, as illustrated in FIG. 6C, the pair of holding members 131 supporting (holding) the sheet P whose leading edge and side edges are aligned are moved from the receiving positions of the sheet P above the stack tray 170 to the outside of the stack tray 170 (outside of both side edges of the sheet P). Accordingly, the sheet P supported (held) by the pair of holding members 131 falls onto the uppermost position of the sheets Po by the action of gravity.

Note that when the sheet P falls onto the uppermost position of the sheets Po, each pair of joggers 120 remain at the side edge alignment positions, so that the alignment state of the leading edges and side edges of the sheets Po, including the falling sheet P, stacked on the stack tray 170 is maintained.

In a state in which the alignment state of the leading edges and the side edges of the sheets Po illustrated in FIG. 6C is maintained, the stapler 140 moves to a predetermined position and performs binding processing on an end portion of the sheet P. Accordingly, the aligned and bound sheet bundle is formed, and is ejected to the shift ejection tray 191 via the second conveyance passage 182 by the second conveyance roller pair 152.

Third Embodiment

Next, sheet holders included in a sheet stacking unit 10 as a sheet stacker according to another embodiment of the present disclosure are described with reference to FIG. 7.

Figure 7:
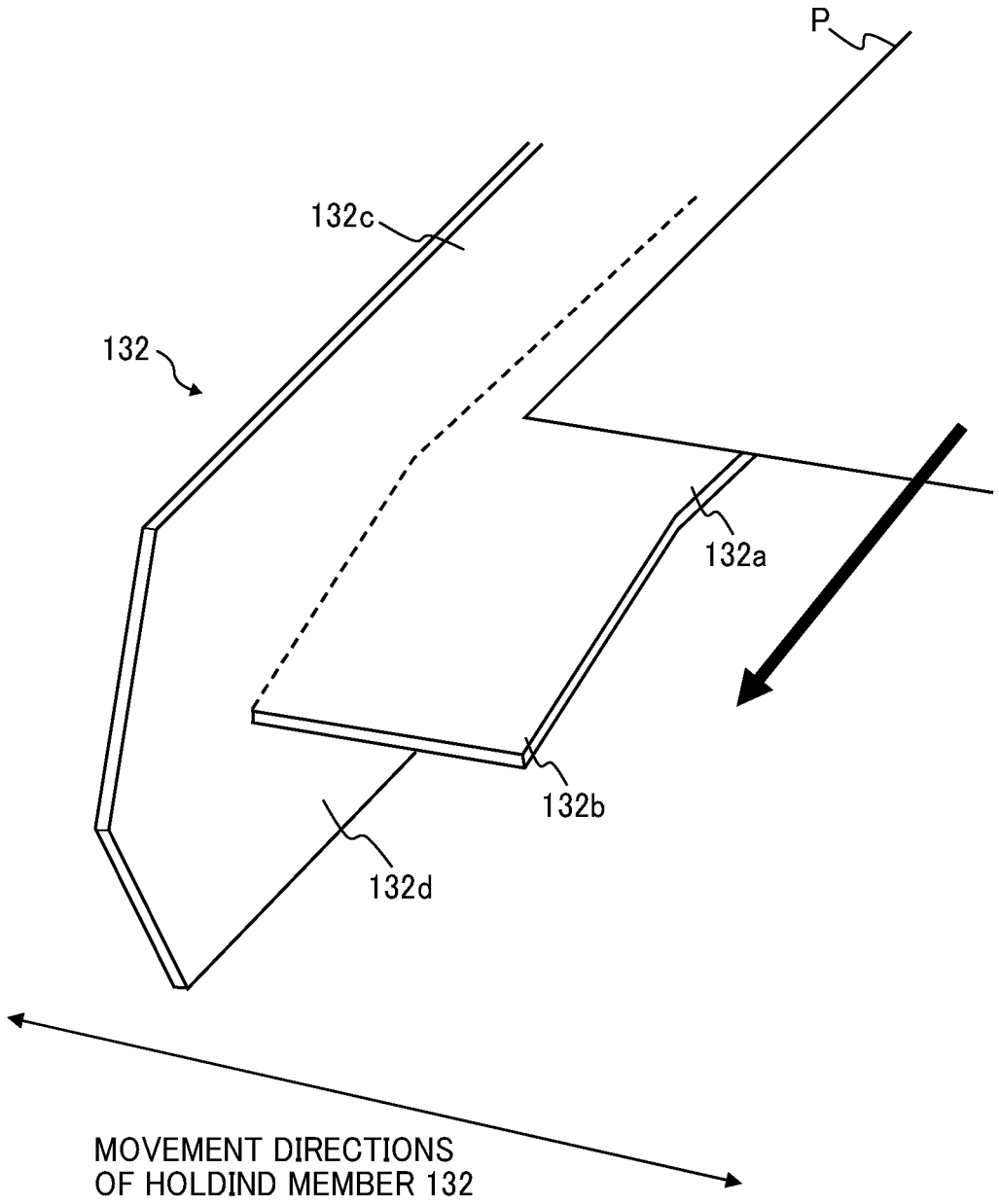
FIG. 7 is an enlarged perspective view illustrating an outline of a sheet stacking unit as a sheet stacker according to a third embodiment of the present disclosure.

FIG. 7 is a perspective view of a holding member 132 according to the present embodiment. Although the sheet stacking unit 10 includes a pair of holding members 132, only one of the holding members 132 is illustrated in FIG. 7.

As illustrated in FIG. 7, each one of the pair of holding members 132 includes a first part and a second part. The first part includes an upper side-surface portion 132*c* and a lower side-surface portion 132*d*. The upper side-surface portion 132*c* regulates the position of a side end portion of a conveyed sheet P. The lower side-surface portion 132*d* contacts side edges of the sheets Po stacked on the stack tray 170. The second part includes a sheet supporting surface (holding surface) 132*a* and an inclined supporting surface 132*b*. The sheet supporting surface 132*a* protrudes from a portion including the upper side-surface portion 132*c* and the lower side-surface portion 132*d* in the width direction of the sheet P (in other words, a direction approaching the other one of the pair of holding members 132). The inclined supporting surface 132*b* is continuous with the sheet supporting surface 132*a* and inclined downward to the downstream side from the sheet supporting surface 132*a* in the conveyance direction of the sheet P.

The sheet supporting surface 132*a* and the inclined supporting surface 132*b* are provided at positions spaced apart from the upper surface of the stack tray 170 by a predetermined distance when the sheet supporting surface 132*a* and the inclined supporting surface 132*b* are positioned above the stack tray 170. Such a configuration allows the conveyed sheet P to be guided and moved (conveyed) to the leading-edge stopper 110 without butting against the stack tray 170 or the uppermost surface of the sheets Po already stacked on the stack tray 170. The sheet supporting surface 132*a* is a surface substantially parallel to the stacking surface of the stack tray 170. The inclined supporting surface 132*b* functions as a guide to guide the leading edge of the sheet P in the conveyance direction so as to butt against the leading-edge stoppers 110.

Similarly to the second embodiment, at the time of receiving the sheet P, the pair of holding members 132 stand by in a state in which the sheet supporting surface 132*a* is positioned above the stack tray 170 (in other words, at the receiving positions at which both side end portions of the sheet P in the width direction of the sheet P can be supported (held)). At this time, the pair of holding members 132 stand by at positions at which the conveyed sheet P does not come into contact with an upstream end portion of each upper side-surface portion 132*c* in the conveyance direction.

After the leading edge of the sheet P comes into contact with the leading-edge stoppers 110 and the sheet P is held for a predetermined period of time, the pair of holding members 132 once move in directions approaching each other to positions at which the upper side-surface portions 132*c* come into contact with both side edges of the sheet P. Then, the pair of holding members 132 move in directions separating from each other toward the outside of the stack tray 170 in the width direction of the stack tray 170 and move to positions at which the separation width between the sheet supporting surfaces 132*a* is equal to or larger than the width dimension of the sheet P. Accordingly, the sheet P falls from the sheet supporting surfaces 132*a* onto the stack tray 170.

After the sheets P are stacked on the stack tray 170, the pair of holding members 132 move in directions to approach each other to positions at which the lower side-surface portions 132*d* butt against both side edges of the sheets P stacked on the stack tray 170. At this time, the side surfaces of the sheets P are aligned. Although the aligning operation is performed before the sheet P is dropped in the above-described example, the aligning operation may be performed only after the sheet P is dropped without being performed before the sheet P is dropped.

That is, the pair of holding members 132 are formed by integrating the pair of holding members 130 exemplified in the first embodiment, the pair of holding members 131 exemplified in the second embodiment, and the pairs of joggers 120, and have the respective functions.

In each one of the pair of holding members 132, the positions of the upper side-surface portion 132*c* and the lower side-surface portion 132*d* may not be arranged on a straight line in the height direction. For example, the upper side-surface portion 132*c* may be located at a position to form a separation width that does not collide with the sheet P at the receiving position of the sheet P. The lower side-surface portion 132*d* may be located at a position to contact the side edge of the sheet P to align the side edge at the receiving position of the sheet P. In other words, when the pair of holding members 132 are viewed from the conveyance direction of the sheet P, the distance between the pair of lower side-surface portions 132*d* is shorter than the distance between the pair of upper side-surface portions 132*c*. Each one of the lower side-surface portions 132*d* is positioned further inward between the upper side-surface portions 132*c* than each one of the upper side-surface portions 132*c*.

Further, the pair of holding members 132 may have only the lower side-surface portion 132*d* without having the upper side-surface portion 132*c*. In such a case, after the sheet P is temporarily supported (held) on the sheet supporting surfaces 132*a* at the receiving positions, the sheet P is dropped. Then, the pair of holding members 132 are moved so as to approach each other in the width direction, thus allowing the side edges of the sheet P to be aligned with the lower side-surface portions 132*d*.

Hardware Configuration of Controller 100

Figure 8:
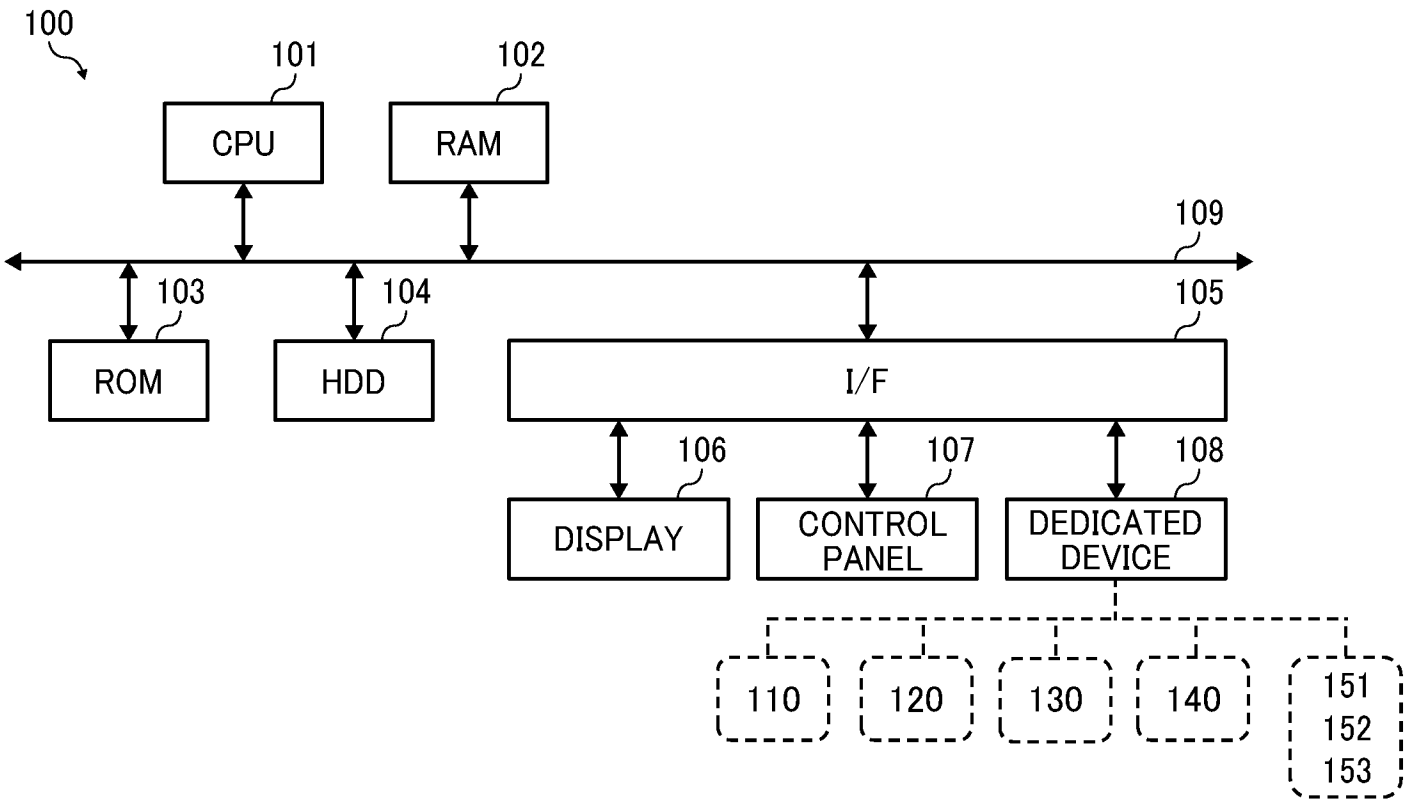
FIG. 8 is a block diagram illustrating a hardware configuration of a controller of a sheet stacking unit according to an embodiment of the present disclosure.

Next, the controller 100 that controls the operation of the sheet stacking unit 10 is described. FIG. 8 is a diagram illustrating a hardware configuration of the controller 100 according to an embodiment of the present disclosure. The hardware configuration illustrated in FIG. 8 includes a similar configuration to the hardware configuration of a general information processing device. In the controller 100 as a control device or circuitry according to the present embodiment, a central processing unit (CPU) 101, a random access memory (RAM) 102 as a storage device, a read only memory (ROM) 103 as a storage device, a hard disk drive (HDD) 104 as a storage device, and an interface (I/F) 105 as an interface are connected via a bus 109 as a communication member. A display 106, a control panel 107, and a dedicated device 108 are connected to the I/F 105.

The CPU 101 is an arithmetic unit and controls the general operations of the sheet stacking unit 10. The RANI 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, e.g., an operating system (OS), various control programs, and application programs. The various control programs include a medium conveyance control program and a post-processing control program.

The I/F 105 connects various types of hardware or networks to the bus 109, and controls the operations performed between the bus 109 and the various hardware and networks. The display 106 is a visual user interface through which a user checks the status of the sheet stacking unit 10 and the set operation mode. The display 106 includes a display device such as a liquid crystal display (LCD). The control panel 107 as an operation unit is a user interface through which a user inputs the settings of the operation mode of the sheet stacking unit 10 and related information of the sheet P.

The dedicated device 108 is hardware for implementing functions of performing dedicated operations in the sheet stacking unit 10, and is a hardware configuration of driving units for operating, for example, the leading-edge stoppers 110, the joggers 120, the holding members 130, the stapler 140, and the first conveyance roller pair 151, the second conveyance roller pair 152, and the third conveyance roller pair 153 constituting the conveyors.

In the controller 100, the CPU 101 reads out programs stored in the ROM 103 or the HDD 104 to the RAM 102 and executed the programs. Thus, the controller 100 constitutes a software controller to achieve the predetermined function using each hardware configuration included in the dedicated device 108.

Figure 9:
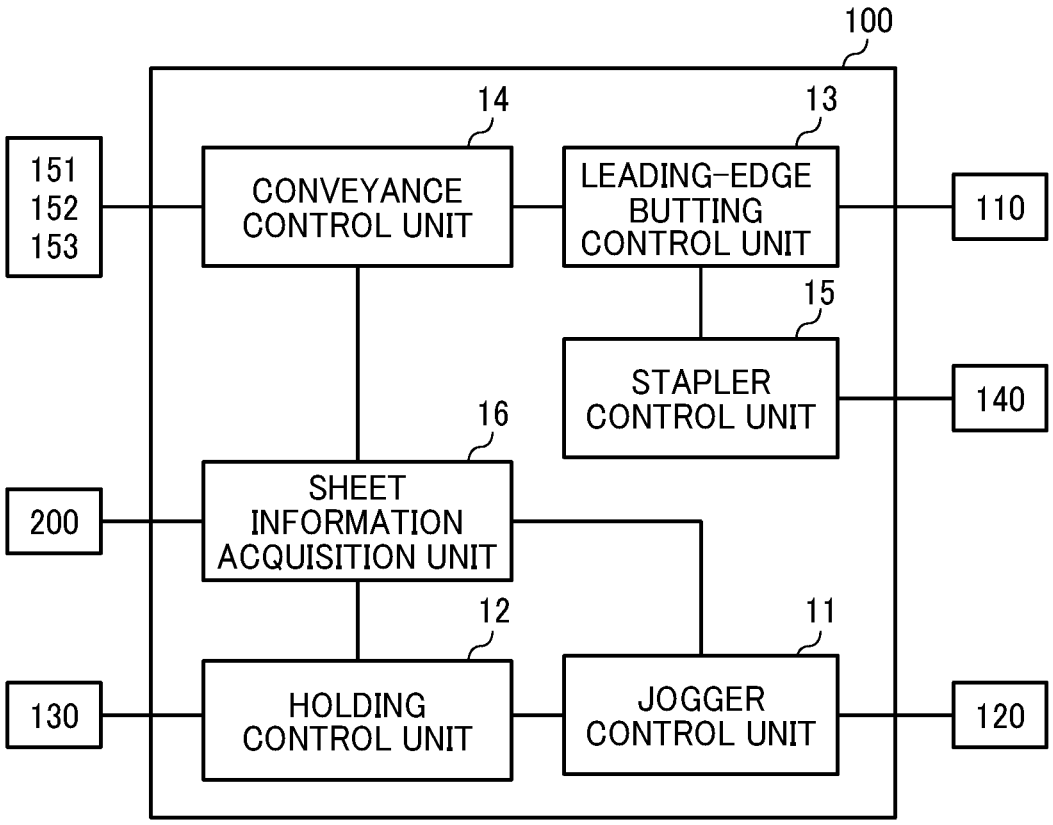
FIG. 9 is a functional block diagram illustrating a functional configuration of a controller of a sheet stacking unit according to an embodiment of the present disclosure.

Functional Block of Controller 100 Next, an example of functional blocks implemented in the controller 100 according to the second embodiment illustrated in FIGS. 5 and 6 is described with reference to FIG. 9. As illustrated in FIG. 9, the controller 100 includes a jogger control unit 11, a holding control unit 12, a leading-edge butting control unit 13, a conveyance control unit 14, a stapler control unit 15, and a sheet information acquisition unit 16. In the present embodiment, the controller 100 also controls the post-processing unit 30.

The jogger control unit 11 controls the operation of the pairs of joggers 120. As described above, when the sheet P is conveyed to the stack tray 170 (when the sheet P is received), each pair of joggers 120 stay at positions separated from each other. Thereafter, the sheets P are stacked in a state in which the leading edges of the sheets P are in contact with the leading-edge stoppers 110. After a predetermined time (a time required for the sheets P to dry or a time required for the sheets P to turn into a state of not disturbing the reception of the next sheet P) has elapsed, each pair of joggers 120 approach each other and move to align the side edges of the sheets P. The jogger control unit 11 controls the joggers 120 to appropriately perform a predetermined operation.

The holding control unit 12 controls the operation of the pair of holding members 131. As described above, the pair of holding members 131 stay at positions above the stack tray 170 when the sheet P is conveyed to the stack tray 170 (in other word, at the time of reception of the sheet P). When the sheet P is conveyed, the side end portions of the sheet P are supported (held) by the pair of holding members 131 and the leading edge of the sheet P comes into contact with the leading-edge stoppers 110. The jogger control unit 11 causes the pairs of joggers 120 to perform the alignment operation, and then the holding control unit 12 causes the pair of holding members 131 to operate so as to separate from each other.

The leading-edge butting control unit 13 controls the operation of the leading-edge stoppers 110 to align the leading edges of the sheet P conveyed to the stack tray 170. First, the leading-edge butting control unit 13 moves the leading-edge stoppers 110 to positions at which the leading-edge stoppers 110 block the sheet P from passing through the conveyance passage of the sheet P. Subsequently, when the leading edge of the sheet P in the conveyance direction is not located at the alignment position at which the leading-edge stoppers 110 can align the leading edge, the leading-edge butting control unit 13 causes the sheet P to move so that the leading edge is located at the alignment position. After the leading edges of a predetermined number of sheets P are aligned and the side edges of the sheets P are also aligned by the joggers 120, the stapler 140 performs binding processing on the sheets P. The leading-edge butting control unit 13 causes the leading-edge stoppers 110 to move to retreat positions at which the sheet P can pass through the conveyance passage of the sheet P and the leading-edge stoppers 110 are retreated from the conveyance passage.

The conveyance control unit 14 controls driving of each one of the first conveyance roller pair 151, the second conveyance roller pair 152, and the third conveyance roller pair 153.

The stapler control unit 15 controls the stapler 140 to move to a predetermined position of a leading end portion of the sheet P and perform binding processing on the leading end portion of the sheet P, after the side edges of the sheet P conveyed to the stack tray 170 are also aligned in a state in which the leading edge of the sheet P is aligned. The stapler control unit 15 causes the stapler 140 move to the retreat positions at which the sheet P can pass through the conveyance passage of the sheet P and the stapler 140 is retreated from the conveyance passage of the bundle of the bound sheets P.

The sheet information acquisition unit 16 acquires sheet-related information, which is information related to the sheet P, from the controller 200 of the inkjet printer 20 serving as an external device with respect to the sheet stacking unit 10, and notifies the sheet-related information to the holding control unit 12, the jogger control unit 11, and the conveyance control unit 14 to use the sheet-related information for the respective controls.

The sheet-related information includes information related to an image forming process on the sheet P. For example, the information related to the formed image includes a printing rate, a used liquid amount (corresponding to a liquid amount attached to the sheet P), and other information that can be used as indexes necessary for calculating a time necessary for drying the sheet P. The sheet-related information may also include information related to attributes of the sheet P such as paper type, thickness, and basis weight that are information indicating the type of the sheet P.

Based on the sheet-related information, the holding control unit 12 described above determines whether the conveyed sheet P does not need to be temporarily supported (held) and may be directly brought into contact with the sheets P stacked on the stack tray 170. For example, when the printing rate is lower than a predetermined threshold value, an image forming surface of the sheet P may be dried before the sheet P reaches the stack tray 170. Therefore, in such a case, the sheet P may be directly brought into contact with the sheets P on the stack tray 170 without being temporarily held by the pair of holding members 131.

Stacking Control Flow

Figure 10:
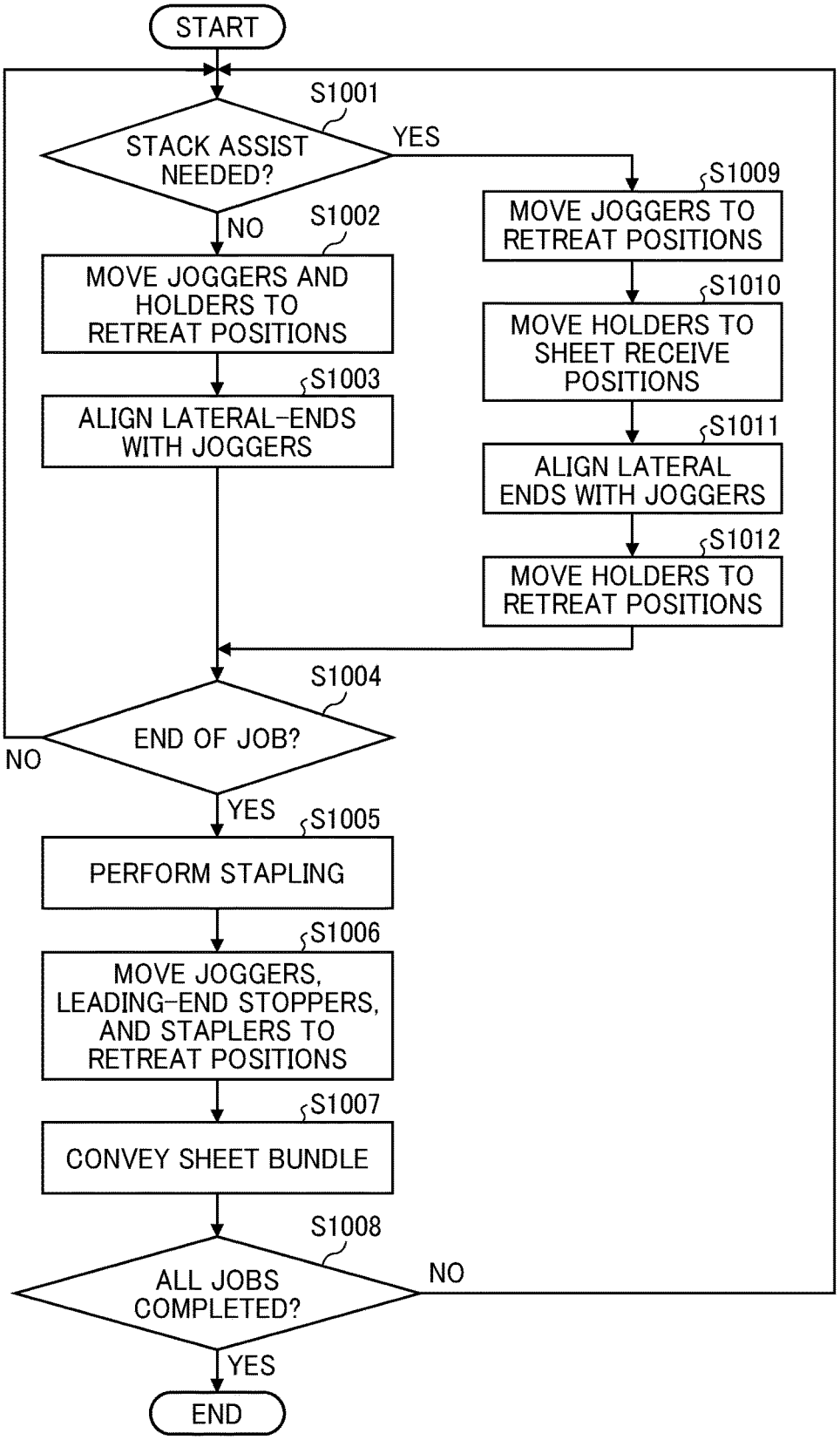
FIG. 10 is a flowchart illustrating a flow of control of a sheet stacking unit according to an embodiment of the present disclosure.

Next, a flow of a stacking control process executed by the controller 100 of the sheet stacking unit 10 is described with reference to a flowchart of FIG. 10. First, the controller 100 acquires sheet-related information related to a conveyed sheet P and determines whether the holding operation by the pair of holding members 131 is necessary (step S1001). If the sheet P does not need stacking assistance because of a low printing rate or the like (NO in step S1001), the controller 100 causes the joggers 120 and the holding members 131 to move to the retreat positions (step S1002). At the timing when the leading edge of the sheet P is aligned by the leading-edge stoppers 110 and stacked on the stack tray 170, the controller 100 causes the joggers 120 to perform the side-edge alignment operation (step S1003).

The controller 100 determines whether the alignment of the sheet bundle is completed in a job for which the alignment processing is designated (step S1004). If the alignment of the sheet bundle has been completed (YES in step S1004), the controller 100 causes the stapler 140 to operate and perform predetermined binding processing (step S1005), and then causes the leading-edge stoppers 110 and the stapler 140 to move from the conveyance passage to the retreat positions (step S1006).

The controller 100 causes the second conveyance roller pair 152 to be driven to convey the sheet bundle having been subjected to the binding processing (step S1007). When all the jobs for which the alignment processing is designated are completed (YES in step S1008), the process ends. When there is an uncompleted job (NO in step S1008), the process returns to step S1001.

In step S1001, if the sheet P to be conveyed next is an object to be held (YES in step S1001), the controller 100 causes the joggers 120 to move to the retreat positions (step S1009) and causes the holding members 131 to move to the initial positions for receiving the sheet P (step S1010).

At a predetermined timing after the leading edge of the sheet P butts against the leading-edge stoppers 110 while the received sheet P is supported (held) by the holding members 131, the controller 100 causes the joggers 120 to perform the side-edge alignment operation (step S1011). Accordingly, both the leading edge and the side edges of the sheet P are located at the alignment positions. Then, the controller 100 causes the holding members 131 to move to the retreat positions (step S1012). Accordingly, the sheet P having been supported by the holding members 131 falls onto the stack tray 170 and is newly stacked on the sheets Po having been conveyed and stacked.

Then, the controller 100 determines whether the alignment of the sheet bundle is completed in a job for which the alignment processing is designated (step S1004). If the alignment of the sheet bundle is not finished (NO in step S1004), the process returns to step S1001.

According to the above-described stacking control according to the present embodiment, even when a sheet P whose image forming surface faces the stack tray 170 is newly conveyed and the image forming surface is not sufficiently dried, the sheet P can be temporarily supported by the holding members and moved to the alignment position. Since the sheet P is dropped onto the stack tray 170 from this state, the image forming surface that is not sufficiently dried can be prevented from being rubbed by another sheet P or a member used for alignment. Accordingly, when the sheet P are stacked on other sheets, the alignment processing can be performed while restraining the sheet P from butting against the other sheets.

The present disclosure is not limited to specific embodiments described above, and numerous additional modifications and variations are possible in light of the teachings within the technical scope of the present disclosure. It is therefore to be understood that the disclosure of the present specification may be practiced otherwise by those skilled in the art than as specifically described herein. Such modifications and alternatives are within the technical scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet stacker, comprising:

a pair of sheet holders disposed so that a downstream side of the pair of sheet holders in a conveyance direction of a conveyed sheet is lowered along the conveyance direction, the pair of sheet holders being movable in an orthogonal direction orthogonal to the conveyance direction of the sheet, the pair of sheet holders being configured to hold both side-end portions of the sheet in the orthogonal direction;

a sheet leading-edge aligner configured to prevent the sheet from passing through a conveyance passage of the sheet, the sheet leading-edge aligner being movable between an alignment position to align a leading edge of the sheet in the conveyance direction and a retreat position to allow the sheet to pass, the sheet leading-edge aligner being configured to align the leading edge of the sheet held by the pair of sheet holders when the sheet leading-edge aligner is at the alignment position;

a sheet stacking tray disposed below the pair of sheet holders so that a downstream side of the sheet stacking tray in the conveyance direction of the sheet is lowered along the conveyance direction, the sheet stacking tray being configured to stack the sheet dropped from the pair of sheet holders after the leading edge of the sheet is aligned by the sheet leading-edge aligner;

control circuitry configured to control operations of the sheet leading-edge aligner and the pair of sheet holders; and a pair of sheet side-edge aligners being movable in the orthogonal direction orthogonal to the conveyance direction of the sheet, wherein the pair of sheet side-edge aligners is configured to align side edges of the sheet in the orthogonal direction, with the sheet held by the pair of sheet holders or the sheet stacked on the sheet stacking tray, wherein the control circuitry is configured to control an operation of the pair of sheet side-edge aligners, the sheet stacker further comprising another pair of sheet holders disposed downstream from the pair of sheet holders in the conveyance direction, wherein the pair of sheet side-edge aligners is disposed between the pair of sheet holders and said another pair of sheet holders in the conveyance direction.

2. The sheet stacker according to claim 1, wherein the control circuitry is configured to control each one of the pair of sheet holders to move toward an outside of the sheet in the orthogonal direction after the leading edge of the sheet comes into contact with the sheet leading-edge aligner.

3. The sheet stacker according to claim 1, wherein the control circuitry is configured to:

cause each one of the pair of sheet holders holding the sheet to move to an outside of the sheet in the orthogonal direction; and cause the pair of sheet side-edge aligners to align the side edges of the sheet in the orthogonal direction after the sheet is stacked on the sheet stacking tray.

4. The sheet stacker according to claim 1, wherein one of the pair of sheet holders and one of the pair of sheet side-edge aligners disposed on a same side in the orthogonal direction with respect to the sheet are integral with each other.

5. The sheet stacker according to claim 1, wherein the control circuitry is configured to:

cause the sheet to be conveyed in a state in which the pair of sheet holders are outside the sheet in the orthogonal direction, based on sheet-related information related to the conveyed sheet; and cause the sheet to be stacked on the sheet stacking without causing the pair of sheet holders to hold the sheet.

6. The sheet stacker according to claim 5, wherein the sheet-related information is information indicating an amount of liquid adhering to the sheet.

7. The sheet stacker according to claim 5, wherein the sheet-related information is information indicating a type of the sheet.

8. A post-processing apparatus comprising:

the sheet stacker according to claim 1;

a post-processing device configured to perform post-processing on a sheet bundle including a plurality of sheets stacked on the sheet stacking tray; and a conveyor configured to convey the sheet bundle on which the post-processing has been performed to a downstream side from the post-processing device in the conveyance direction, wherein the control circuitry is configured to cause the sheet leading-edge aligner and the post-processing device to retreat from the conveyance passage after the post-processing has been performed on the sheet bundle.

9. An image forming system, comprising:

an image forming device configured to discharge liquid onto a sheet to form an image;

a conveying device configured to convey the sheet; and the post-processing apparatus according to claim 8 configured to perform the post-processing on a sheet bundle including the sheet on which the image is formed by the image forming device and conveyed by the conveying device.

10. The sheet stacker according to claim 1, wherein:

the sheet held by the pair of sheet holders is dropped onto other sheets which are on the sheet stacking tray, without the sheet sliding on the other sheet.

11. The sheet stacker according to claim 1, further comprising:

another sheet leading-edge aligner which operates at a same time said sheet leading-edge aligner.

12. The sheet stacker according to claim 1, wherein:

the sheet leading-edge aligner is further configured to align the leading ge of the she when the sheet is stacked in the sheet stacking tray, after the sheet is lowered from the pair of sheet holders.

* * * * *